US012396479B2

(12) United States Patent
Seo et al.

(10) Patent No.: US 12,396,479 B2
(45) Date of Patent: Aug. 26, 2025

(54) COOLING STRUCTURE AND A SMOKING ARTICLE INCLUDING THE SAME

(71) Applicant: KT&G CORPORATION, Daejeon (KR)

(72) Inventors: Jung Kyu Seo, Daejeon (KR); Jae Hyun Lee, Daejeon (KR); Young Rim Han, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 661 days.

(21) Appl. No.: 17/596,337

(22) PCT Filed: Dec. 4, 2020

(86) PCT No.: PCT/KR2020/017645
§ 371 (c)(1),
(2) Date: Dec. 8, 2021

(87) PCT Pub. No.: WO2021/167213
PCT Pub. Date: Aug. 26, 2021

(65) Prior Publication Data

US 2022/0248746 A1 Aug. 11, 2022

(30) Foreign Application Priority Data

Feb. 17, 2020 (KR) ..... 10-2020-0019329

(51) Int. Cl.
*A24D 3/10* (2006.01)
*A24D 3/04* (2006.01)
*A24D 1/20* (2020.01)

(52) U.S. Cl.
CPC ..... *A24D 3/043* (2013.01); *A24D 3/048* (2013.01); *A24D 3/10* (2013.01); *A24D 1/20* (2020.01)

(58) Field of Classification Search
None
See application file for complete search history.

(56) References Cited

U.S. PATENT DOCUMENTS 6,851,643 B2 2/2005 Qiu et al.
7,243,659 B1 7/2007 Lecoultre et al.
7,987,857 B2 8/2011 Seitert et al.
(Continued)

FOREIGN PATENT DOCUMENTS

CN 104010531 A 8/2014
CN 104540402 A 4/2015
(Continued)

OTHER PUBLICATIONS

JP-2019523639-A, English machine translation, EPO (Year: 2019).*
(Continued)

*Primary Examiner* — Michael H. Wilson
*Assistant Examiner* — Michael T Fulton
(74) *Attorney, Agent, or Firm* — Sughrue Mion, PLLC

(57) ABSTRACT

A cooling structure, which is located downstream of a smoking material portion provided in a smoking article and located upstream of a mouthpiece portion, includes: a body portion that has a tube shape having a hollow therein and is made of a paper material; and a plurality of perforations that are arranged in a circumferential direction of the body portion such that the inside and outside of the body portion are in fluid communication with each other.

13 Claims, 5 Drawing Sheets

(56) References Cited

U.S. PATENT DOCUMENTS

| | | | | |
|---|---|---|---|---|
| 9,185,939 | B2 | 11/2015 | Jarriault et al. | |
| 9,894,930 | B2 | 2/2018 | Bonici et al. | |
| 10,357,057 | B2 | 7/2019 | Kadiric | |
| 2005/0039764 | A1* | 2/2005 | Barnes | A24C 5/20 131/284 |
| 2007/0215167 | A1 | 9/2007 | Llewellyn Crooks et al. | |
| 2007/0215168 | A1 | 9/2007 | Banerjee et al. | |
| 2015/0027475 | A1* | 1/2015 | Jarriault | A24D 1/20 131/329 |
| 2015/0059780 | A1* | 3/2015 | Davis | A24F 40/46 392/386 |
| 2015/0208722 | A1 | 7/2015 | Kadiric | |
| 2016/0128378 | A1* | 5/2016 | Kuersteiner | A24D 1/02 131/331 |
| 2016/0208440 | A1 | 7/2016 | Byrd, Jr. et al. | |
| 2016/0309776 | A1 | 10/2016 | Pammer | |
| 2018/0177225 | A1* | 6/2018 | Jaramillo | A24D 3/10 |
| 2019/0116874 | A1 | 4/2019 | England et al. | |
| 2019/0335805 | A1 | 11/2019 | Kadiric | |
| 2020/0352231 | A1 | 11/2020 | Han et al. | |
| 2021/0000180 | A1 | 1/2021 | Hwang et al. | |
| 2021/0015147 | A1 | 1/2021 | Mair et al. | |
| 2021/0092989 | A1 | 4/2021 | Han et al. | |
| 2022/0087311 | A1 | 3/2022 | Han et al. | |
| 2022/0117293 | A1 | 4/2022 | Zuber et al. | |
| 2023/0042344 | A1 | 2/2023 | Zuber et al. | |

FOREIGN PATENT DOCUMENTS

| | | | | | |
|---|---|---|---|---|---|
| CN | 105828645 | A | | 8/2016 | |
| CN | 207912052 | U | | 9/2018 | |
| CN | 208192123 | U | | 12/2018 | |
| CN | 208192125 | U | | 12/2018 | |
| CN | 110037338 | A | | 7/2019 | |
| CN | 110810905 | A | * | 2/2020 | A24D 1/002 |
| CN | 110934328 | A | | 3/2020 | |
| EP | 3 748 079 | A1 | | 12/2020 | |
| GB | 2 159 386 | A | | 12/1985 | |
| JP | H05211861 | A | * | 8/1993 | |
| JP | H09194811 | A | * | 7/1997 | |
| JP | 5007305 | B2 | | 8/2012 | |
| JP | 2015-503335 | A | | 2/2015 | |
| JP | 2015-107135 | A | | 6/2015 | |
| JP | 6469024 | B2 | | 2/2019 | |
| JP | 2019-126290 | A | | 8/2019 | |
| JP | 2019523639 | A | * | 8/2019 | |
| KR | 10-2008-0012749 | A | | 2/2008 | |
| KR | 10-2015-0040811 | A | | 4/2015 | |
| KR | 10-1586970 | B1 | | 1/2016 | |
| KR | 10-2019-0114226 | A | | 10/2019 | |
| TW | 202025920 | A | * | 7/2020 | |
| WO | 2013/098405 | A2 | | 7/2013 | |
| WO | WO-2013120565 | A2 | * | 8/2013 | A24D 1/04 |
| WO | 2017/198837 | A1 | | 11/2017 | |
| WO | 2019/105750 | A1 | | 6/2019 | |
| WO | 2019/151695 | A1 | | 8/2019 | |
| WO | 2019/166308 | A1 | | 9/2019 | |
| WO | 2020/032715 | A1 | | 2/2020 | |
| WO | 2020/100876 | A1 | | 5/2020 | |
| WO | 2020/105944 | A1 | | 5/2020 | |

OTHER PUBLICATIONS

JP-H09194811-A English machine translation, PE2E (Year: 1997).*
JP-H05211861-A, English machine translation, PE2E (Year: 1993).*
CN-110810905-A, English machine translation, EPO (Year: 2020).*
TW-202025920-A, English machine translation, PE2E (Year: 2020).*
Chinese Office Action dated Jan. 23, 2024 in Application No. 202080048668.7.
Extended European Search Report dated Jun. 22, 2022 in European Application No. 20919535.3.
Notification of Reasons for Refusal dated Jan. 31, 2023 from the Japanese Patent Office in application No. 2021-572950.
Korea Intellectual Property Office Notification of Reason for Refusal for KR 10-2020-0019329 dated Oct. 7, 2021.
International Search Report for PCT/KR2020/017645 dated Mar. 22, 2021 [PCT/ISA/210].
Written Opinion for PCT/KR2020/017645 dated Mar. 22, 2021 [PCT/ISA/237].
Office Action dated Apr. 23, 2023 from the Chinese Patent Office in Application No. 202080048668.7.
Communication dated Jun. 11, 2025 in European Application No. 20919535.3.
Communication dated Jun. 17, 2025 in European Application No. 20919535.3.

* cited by examiner

【Figure 1】
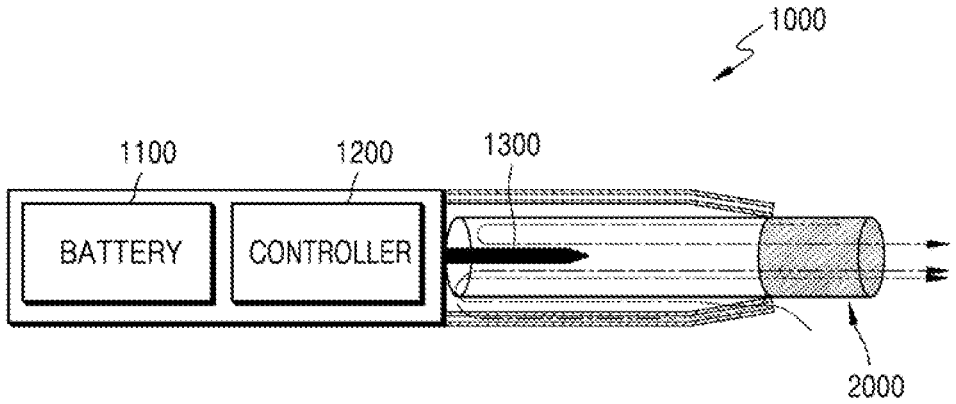
【Figure 2】
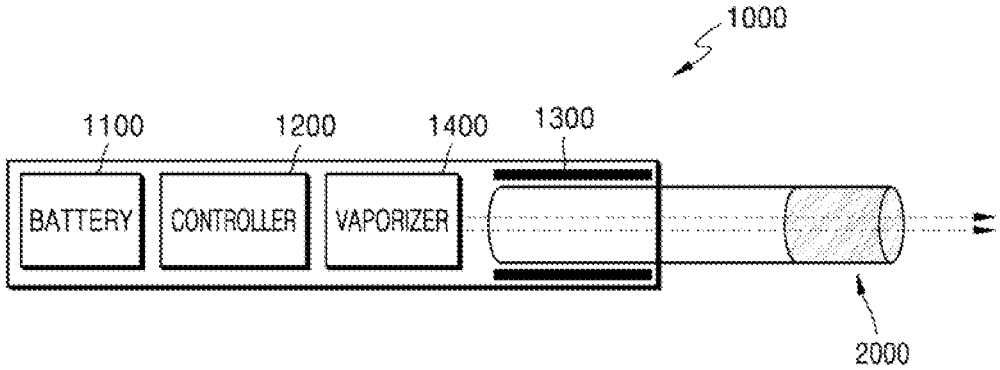
【Figure 3】
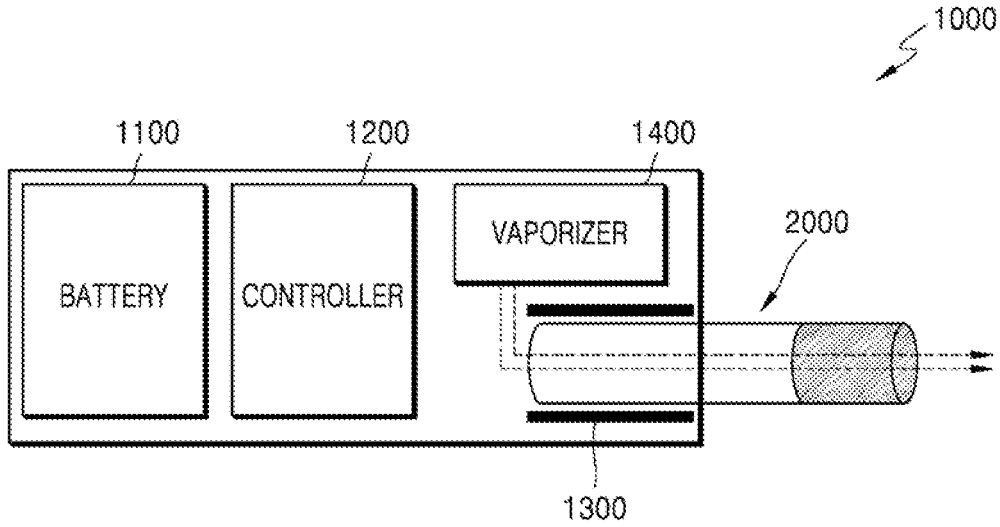

【Figure 4】
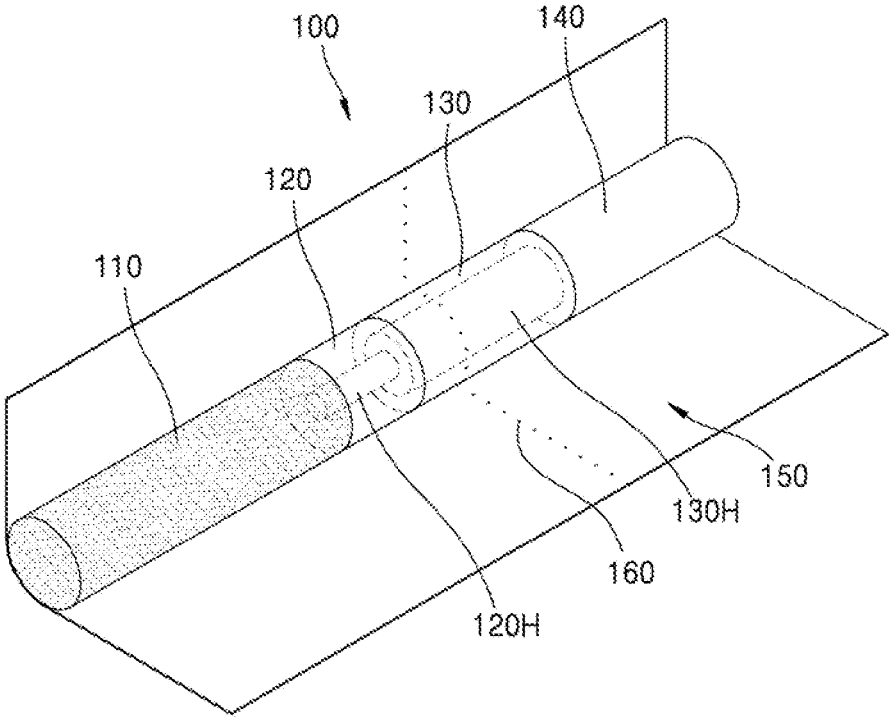
【Figure 5】
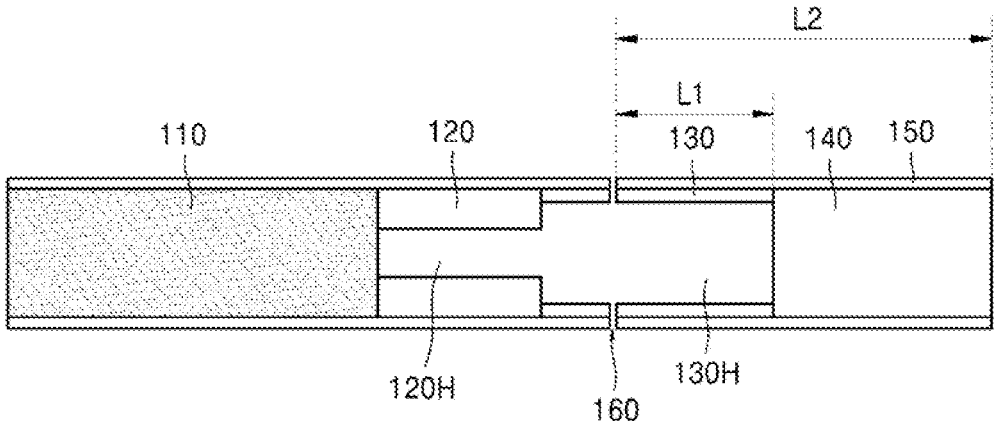

【Figure 6】
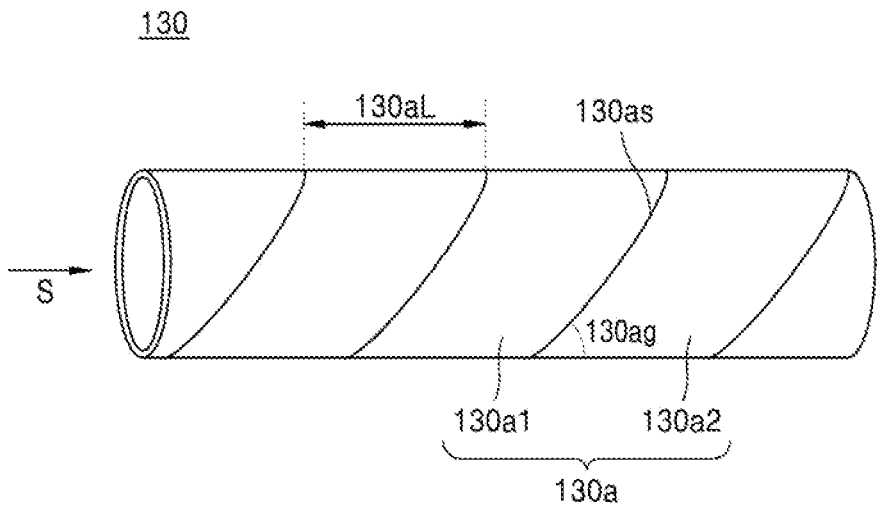
【Figure 7】
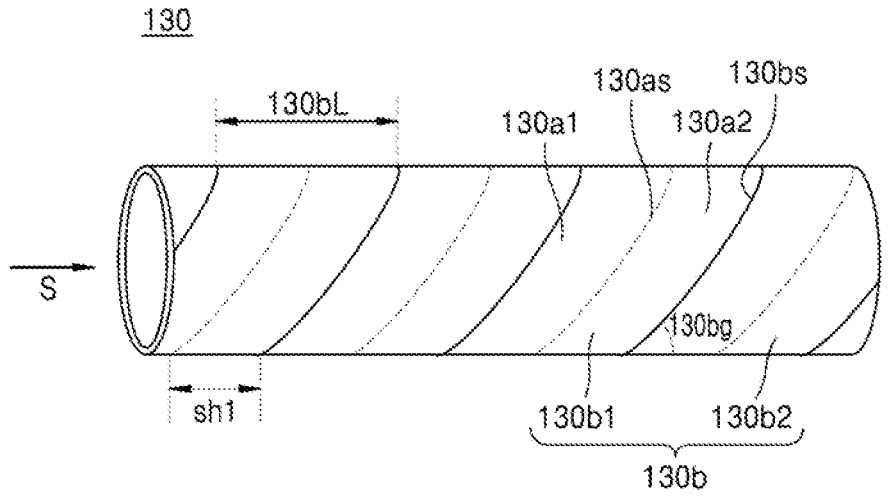

【Figure 8】
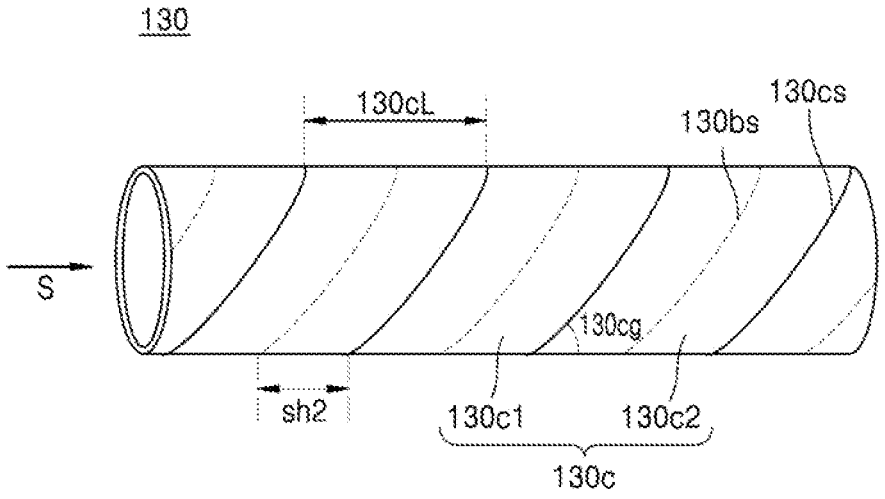
【Figure 9】
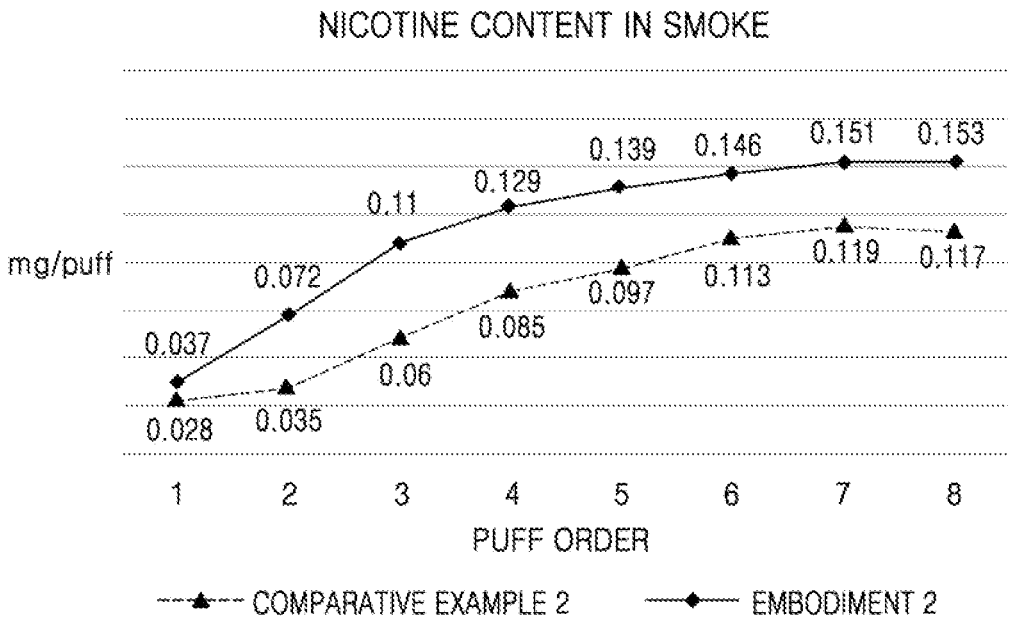

【Figure 10】
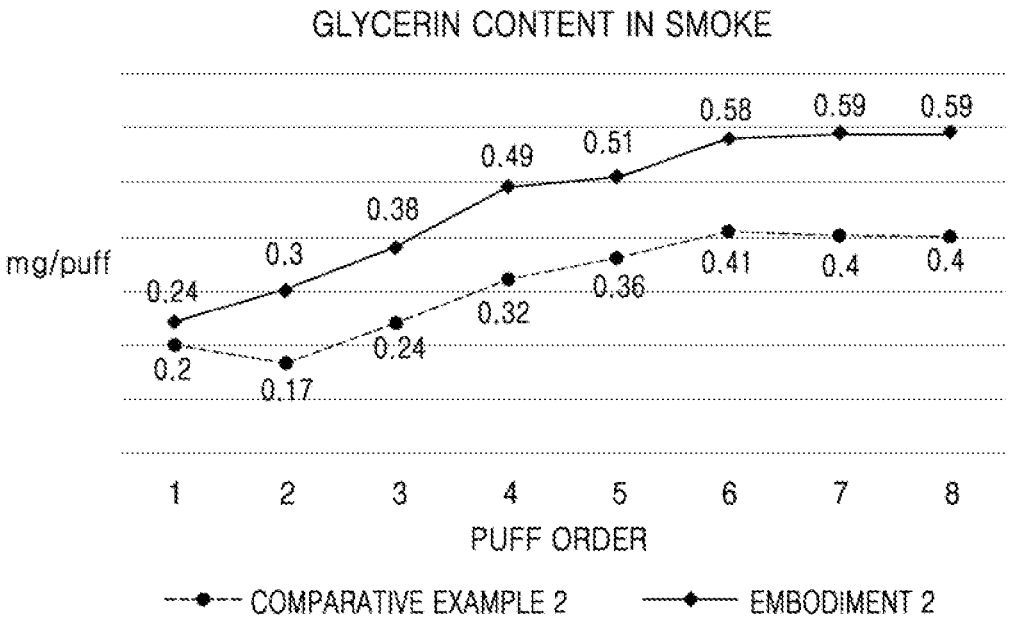
【Figure 11】
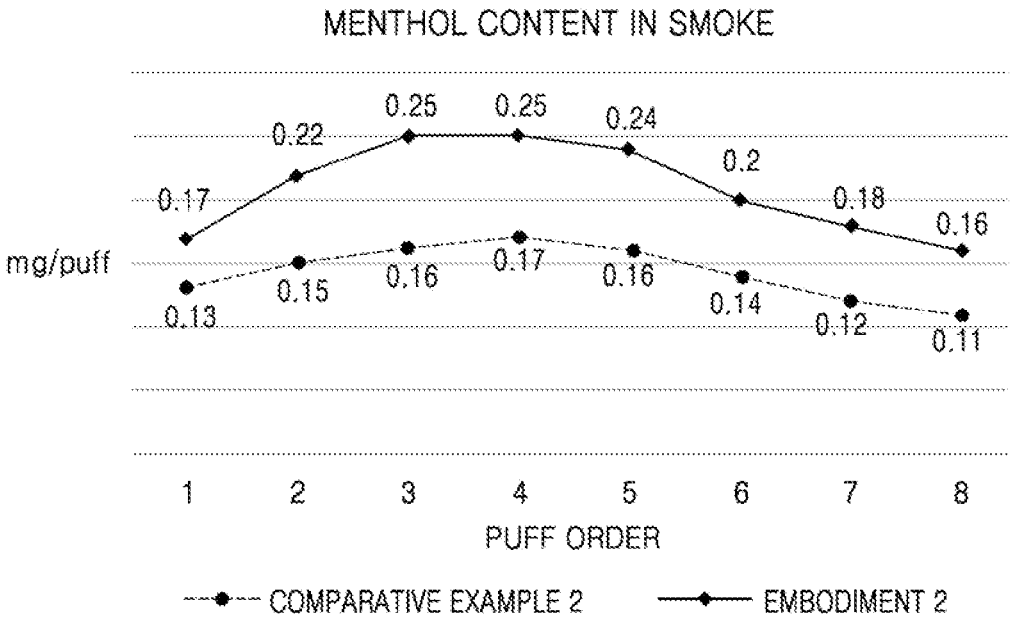

COOLING STRUCTURE AND A SMOKING ARTICLE INCLUDING THE SAME

CROSS REFERENCE TO RELATED APPLICATIONS

This application is a National Stage of International Application No. PCT/KR2020/017645 filed Dec. 4, 2020, claiming priority based on Korean Patent Application No. 10-2020-0019329 filed Feb. 17, 2020.

TECHNICAL FIELD

One or more embodiments of the present disclosure relate to a cooling structure and a smoking article including the same, and more particularly, to a cooling structure capable of improving a unique taste and flavor of a cigarette by a flavored-tube and a paper tube cooling structure disposed between a smoking material portion and a mouthpiece portion, and a smoking article including the same.

BACKGROUND ART

Research on technology for adding a flavor to an aerosol provided from a cigarette is underway. For example, a transfer jet nozzle system (TJNS) filter in which a flavoring is sprayed has been employed in cigarette manufacturing.

Even if a flavoring liquid is added to each component constituting a cigarette such as a medium portion and/or a filter to increase flavor during smoking, there exists a limit to the amount of flavoring liquid due to a manufacturing process. In addition, as time elapses, the flavoring liquid (e.g., menthol) applied in the filter is transferred to an adjacent unflavored structure, resulting in a problem that the amount of menthol transfer rapidly decreases during smoking. Moreover, if design of a cooling structure or a cigarette including the same is only focused on increasing the amount of menthol transfer, thermal deformation of a cellulose acetate filter or the like may occur, causing a problem that the amount of atomization or the amount of nicotine transfer is rapidly reduced.

DISCLOSURE

Technical Problem

One or more embodiments of the present disclosure provide a cooling structure and a smoking article including the same which are capable of maximizing a smoking taste by increasing the amount of menthol transfer, the amount of nicotine transfer, and the amount of atomization during smoking.

Embodiments of the present disclosure are not limited thereto. It is to be appreciated that other embodiments will be apparent to those skilled in the art from consideration of the specification and the accompanying drawings of the present disclosure described herein.

Technical Solution

According to some embodiments of the present disclosure, a smoking article may include: a smoking material portion; a cooling structure made of a paper material, having a tube shape, and located downstream of the smoking material portion; a mouthpiece portion located downstream of the cooling structure; and a wrapper surrounding the smoking material portion, the cooling structure, and the mouthpiece portion, wherein the cooling structure includes a body portion having a tube shape and made of a paper material, and a plurality of perforations arranged in a circumferential direction of the body portion such that the inside and outside of the body portion are in fluid communication with each other.

According to some embodiments of the present disclosure, a cooling structure, which is located downstream of a smoking material portion provided in a smoking article and upstream of a mouthpiece portion provided in the smoking article, includes a body portion that has a tube shape having a hollow therein and is made of a paper material; and a plurality of perforations that are arranged in a circumferential direction of the body portion such that the inside and outside of the body portion are in fluid communication with each other.

Advantageous Effects

The cooling structure of a smoking article according to one or more embodiments of the present disclosure may secure rigidity and airtightness of the cooling structure required in a subsequent process, and at the same time may prevent contamination of a paper tube from the outside and separation of a spiral layer, and uniformity and flatness of the structure may be ensured.

The smoking article may minimize the loss of flavor such as menthol during a storage period between manufacture and use of a cigarette, maximize a cooling effect of mainstream smoke when smoking a cigarette to reduce heat deformation of a mouthpiece filter, and efficiently increase the amount of atomization, nicotine transfer amount, and menthol transfer amount compared to other cigarettes to which the same amount of menthol-flavored liquid is added, thereby increasing a smoker's satisfaction.

DESCRIPTION OF DRAWINGS

FIGS. 1 to 3 are diagrams illustrating examples in which a cigarette is inserted into an aerosol generating device.

FIG. 4 is a diagram illustrating a schematic configuration of a smoking article including a cooling structure according to an embodiment.

FIG. 5 is a cross-sectional view of a smoking article according to an embodiment.

FIGS. 6 to 8 are diagrams illustrating a layer structure of a cooling structure according to an embodiment.

FIG. 9 is a graph showing nicotine content in smoke for each puff on a smoking article according to an embodiment.

FIG. 10 is a graph showing glycerin content in smoke for each puff on a smoking article according to an embodiment.

FIG. 11 is a graph showing menthol content for puff on a smoking article according to an embodiment.

BEST MODE

According to one or more embodiments, a smoking article may include a smoking material portion; a cooling structure made of a paper material, having a tube shape, and located downstream of the smoking material portion; a mouthpiece portion located downstream of the cooling structure; and a wrapper surrounding the smoking material portion, the cooling structure, and the mouthpiece portion, wherein the cooling structure comprises a plurality of perforations arranged in a circumferential direction of the cooling structure such that an outside and an inside of the cooling structure are in fluid communication with each other.

The smoking article including the cooling structure may further include a support structure arranged between the smoking material portion and the cooling structure, having a tube shape, made of cellulose acetate, and flavored with a flavoring substance.

An inner diameter of the cooling structure may be larger than an inner diameter of the flavored tube filter.

The inner diameter of the cooling structure may be 1.5 times to 3 times larger than the inner diameter of the support structure.

A length of the support structure in an axial direction may be 8 mm to 12 mm, a length of the cooling structure in the axial direction may be 12 mm to 16 mm, and a length of the mouthpiece portion in the axial direction may be 8 mm to 12 mm.

The plurality of perforations may be formed away from a downstream end of the cooling structure by 5 mm to 10 mm in an upstream direction, and away from a downstream end of the smoking article by 15 mm to 25 mm in an upstream direction.

The support structure may contain 1 mg to 13 mg of a flavoring substance.

An air dilution rate of the cooling structure may be 0% to 50%.

According to one or more embodiments, a cooling structure is located downstream of a smoking material portion provided in a smoking article and upstream of a mouthpiece portion provided in the smoking article and includes a body portion having a tube shape and made of a paper material; and a plurality of perforations arranged in a circumferential direction of the body portion such that an inside and an outside of the body portion are in fluid communication with each other.

An inner diameter of the cooling structure may be 90% to 95% of an outer diameter of the cooling structure, and a roundness of the cooling structure may be 90% to 99%.

A total surface area of the cooling structure may be 500 mm2 to 700 mm2, and a basis weight of the cooling structure may be 100 gsm to 220 gsm.

The body portion may be formed by an inner layer paper spiral layer, an intermediate layer paper spiral layer, and an outer layer paper spiral layer, which are sequentially stacked.

Here, the inner layer paper spiral layer may be formed of paper having a basis weight of 50 gsm to 70 gsm and a thickness of 0.05 mm to 0.10 mm, the intermediate layer paper spiral layer may be formed of paper having a basis weight of 100 gsm to 160 gsm and a thickness of 0.1 mm to 0.2 mm, and the outer layer paper spiral layer may be formed of paper having a basis weight of 100 gsm to 160 gsm and a thickness of 0.1 mm to 0.2 mm.

In addition, the inner layer paper spiral layer and the intermediate layer paper spiral layer may be attached to each other by an adhesive, the intermediate layer paper spiral layer and the outer layer paper spiral layer may be attached to each other by the adhesive, and the adhesive may be ethylene vinyl acetate (EVA) containing solids of 30 wt % to 60 wt %, and having a viscosity of 12,000 cps to 18,000 cps and a pH of 3 to 6.

A downstream end of a first inner layer paper surface forming the inner layer paper spiral layer and an upstream end of a second inner layer paper surface adjacent to the first inner layer paper surface may be separated from each other by 0 mm to 2 mm, a downstream end of a first intermediate layer paper surface forming the intermediate layer paper spiral layer and an upstream end of a second intermediate layer paper surface adjacent to the first intermediate layer paper surface may be separated from each other by 0 mm to 2 mm, and a downstream end of a first outer layer paper surface forming the outer layer paper spiral layer and an upstream end of a second outer layer paper surface adjacent to the first outer layer paper surface may overlap with each other by 0 mm to 2 mm.

An angle between an axial line of the smoking article and a line defining the downstream end of the first inner layer paper surface, the downstream end of the first intermediate layer paper surface, and the downstream end of the first outer layer paper surface may be 30° to 60°.

The downstream end of the first intermediate layer paper surface may be shifted from the downstream end of the first inner layer paper surface by 5 mm to 15 mm in an axial direction of the smoking article, and the downstream end of the first outer layer paper surface may be shifted from the downstream end of the first intermediate layer paper surface by 5 mm to 15 mm in the axial direction of the smoking article.

Mode for Invention

Hereinafter, preferred embodiments will be described in detail with reference to the accompanying drawings. Advantages and features, and a method of achieving the same will become apparent with reference to the embodiments described below in detail together with the accompanying drawings. However, the present disclosure is not limited to the embodiments to be described below, and may be implemented in various different forms. The embodiments are provided only to make the present disclosure complete, and to inform those of ordinary skill in the art to which the present disclosure pertains of the scope, and therefore the present disclosure will be defined by the scope of the claims. Like reference numerals refer to like elements throughout the specification and drawings.

Unless otherwise defined, all terms (including technical and scientific terms) used in the present specification may be used as meanings that may be commonly understood by those of ordinary skill in the art to which the present disclosure pertains. In addition, terms defined in a commonly used dictionary are not interpreted ideally or excessively unless explicitly defined specifically.

In the present disclosure, a singular form may include a plural form unless otherwise specified in phrases. As used herein, "comprises" and/or "comprising" refers to that the recited component, step, action and/or element does not preclude the presence or addition of one or more other components, steps, actions and/or elements.

As used herein, terms including an ordinal number such as "first" or "second" may be used to describe various components, but the components should not be limited by the terms. The terms are used only for the purpose of distinguishing one component from other components.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element or layer is referred to as being "over," "above," "on," "connected to" or "coupled to" another element or layer, it can be directly over, above, on, connected or coupled to the other element or layer or intervening elements or layers may be present. In contrast, when an element is referred to as being "directly over,"

"directly above," "directly on," "directly connected to" or "directly coupled to" another element or layer, there are no intervening elements or layers present. Like numerals refer to like elements throughout.

Throughout the specification, a "smoking article" may refer to any types of articles that may generate an aerosol, such as cigarettes and cigars. The smoking article may include an aerosol generating material or an aerosol forming substrate. In addition, the smoking article may include a solid material based on tobacco raw materials, such as reconstituted tobacco, cut filler, and the like. The smoking material may include volatile compounds.

In addition, throughout the specification, 'upstream' or an 'upstream direction' refers to a direction away from the mouth of a user smoking a smoking article, and 'downstream' or a 'downstream direction' refers to a direction closer to the mouth of a user smoking a smoking article. For example, in a smoking article 100 shown in FIG. 1, a smoking material portion 110 is located upstream or in an upstream direction of filters 120, 130, and 140.

FIGS. 1 through 3 are diagrams showing examples in which a cigarette is inserted into an aerosol generating device.

Referring to FIG. 1, the aerosol generating device 1000 may include a battery 1100, a controller 1200, and a heater 1300. The cigarette 2000 may be inserted into an inner space of the aerosol generating device 1000. Referring to FIGS. 2 and 3, the aerosol generating device 1000 may further include a vaporizer 1400.

FIGS. 1 through 3 only illustrate some components of the aerosol generating device 1000, which are related to the relevant embodiments. Therefore, it will be understood by one of ordinary skill in the art related to the present embodiment that other components may be further included in the aerosol generating device 1000, in addition to the components illustrated in FIGS. 1 through 3.

Also, FIGS. 2 and 3 illustrate that the aerosol generating device 1000 includes the heater 1300. However, the heater 1300 may be omitted according to embodiments.

FIG. 1 illustrates that the battery 1100, the controller 1200, and the heater 13000 are arranged in series, and also FIG. 2 illustrates that the battery 1100, the controller 1200, the vaporizer 1400, and the heater 1300 are arranged in series. FIG. 3 illustrates that the vaporizer 1400 and the heater 1300 are arranged in parallel. However, the internal structure of the aerosol generating device 1000 is not limited to the structures illustrated in FIGS. 1 through 3. In other words, according to the design of the aerosol generating device 1000, the battery 1100, the controller 1200, the heater 1300, and the vaporizer 1400 may be differently arranged.

When the cigarette 2000 is inserted into the aerosol generating device 1000, the aerosol generating device 1000 may operate the heater 1300 and/or the vaporizer 1400 to generate an aerosol from the cigarette 2000 and/or the vaporizer 1400. The aerosol generated by the heater 1300 and/or the vaporizer 1400 is delivered to a user by passing through the cigarette 2000. According to necessity, even when the cigarette 2000 is not inserted into the aerosol generating device 1000, the aerosol generating device 1000 may heat the heater 1300.

The battery 1100 may supply power to be used for the aerosol generating device 1000 to operate. For example, the battery 1100 may supply power to heat the heater 1300 or the vaporizer 1400, and may supply power for operating the controller 1200. Also, the battery 1100 may supply power for operations of a display, a sensor, a motor, etc. mounted in the aerosol generating device 1000.

The controller 1200 may generally control operations of the aerosol generating device 1000. In detail, the controller 1200 may control not only operations of the battery 1100, the heater 1300, and the vaporizer 1400, but also operations of other components included in the aerosol generating device 1000. Also, the controller 1200 may check a state of each of the components of the aerosol generating device 1000 to determine whether or not the aerosol generating device 1000 is able to operate.

The controller 1200 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The heater 1300 may be heated by the power supplied from the battery 1100. For example, when the cigarette 2000 is inserted into the aerosol generating device 1000, the heater 1300 may be inserted into a partial area inside the cigarette 2000, and the heated heater 1300 may increase a temperature of an aerosol generating material in the cigarette 2000.

The heater 1300 may include an electro-resistive heater. For example, the heater 1300 may include an electrically conductive track, and the heater 1300 may be heated when currents flow through the electrically conductive track. However, the heater 1300 is not limited to the example described above and may include all heaters which may be heated to a desired temperature. Here, the desired temperature may be pre-set in the aerosol generating device 1000 or may be set as a temperature desired by a user.

As another example, the heater 1300 may include an induction heater. In detail, the heater 1300 may include an electrically conductive coil for heating a cigarette 2000 in an induction heating method, and the cigarette 2000 may include a susceptor (not shown) which may be heated by the induction heater.

For example, the heater 1300 may include a tube-type heating element, a plate-type heating element, a needle-type heating element, or a rod-type heating element (not shown), and may heat the inside or the outside of the cigarette 2000, according to the shape of the heating element.

Also, the aerosol generating device 1000 may include a plurality of heaters 1300. Here, the plurality of heaters 1300 may be inserted into the cigarette 2000 or may be arranged outside the cigarette 2000. Also, some of the plurality of heaters 1300 may be inserted into the cigarette 2000 and the others may be arranged outside the cigarette 2000. In addition, the heater 1300 is not limited to the shapes illustrated in FIGS. 1 through 3, and may have various shapes.

The vaporizer 1400 may generate an aerosol by heating a liquid composition and the generated aerosol may pass through the cigarette 2000 to be delivered to a user.

In other words, the aerosol generated via the vaporizer 1400 may move along an air flow passage of the aerosol generating device 1000 and the air flow passage may be configured such that the aerosol generated via the vaporizer 1400 passes through the cigarette 2000 to be delivered to the user.

For example, the vaporizer 1400 may include a liquid storage, a liquid delivery element, and a heating element, but it is not limited thereto. For example, the liquid storage, the liquid delivery element, and the heating element may be included in the aerosol generating device 1000 as independent modules.

The liquid storage may store a liquid composition. For example, the liquid composition may be a liquid including a tobacco-containing material having a volatile tobacco flavor component, or a liquid including a non-tobacco material. The liquid storage may be formed to be detachable from the vaporizer 1400 or may be formed integrally with the vaporizer 1400.

For example, the liquid composition may include water, a solvent, ethanol, plant extract, spices, flavorings, or a vitamin mixture. The spices may include menthol, peppermint, spearmint oil, and various fruit-flavored ingredients, but are not limited thereto. The flavorings may include ingredients capable of providing various flavors or tastes to a user.

Vitamin mixtures may be a mixture of at least one of vitamin A, vitamin B, vitamin C, and vitamin E, but are not limited thereto. Also, the liquid composition may include an aerosol forming substance, such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivery element. For example, the heating element may be a metal heating wire, a metal hot plate, a ceramic heater, or the like, but is not limited thereto. In addition, the heating element may include a conductive filament such as nichrome wire and may be positioned as being wound around the liquid delivery element.

The heating element may be heated by a current supply and may transfer heat to the liquid composition in contact with the heating element, thereby heating the liquid composition. As a result, aerosol may be generated.

For example, the vaporizer 1400 may be referred to as a cartomizer or an atomizer, but it is not limited thereto.

The aerosol generating device 1000 may further include general-purpose components in addition to the battery 1100, the controller 1200, the heater 13000, and the vaporizer 1400. For example, the aerosol generating device 1000 may include a display capable of outputting visual information and/or a motor for outputting haptic information. Also, the aerosol generating device 1000 may include at least one sensor (e.g., a puff detecting sensor, a temperature detecting sensor, a cigarette insertion detecting sensor, etc.). Also, the aerosol generating device 1000 may be formed as a structure where, even when the cigarette 2000 is inserted into the aerosol generating device 1000, external air may be introduced or internal air may be discharged.

Although not illustrated in FIGS. 1 through 3, the aerosol generating device 1000 and an additional cradle (not shown) may form together a system. For example, the cradle may be used to charge the battery 1100 of the aerosol generating device 1000. Alternatively, the heater 1300 may be heated when the cradle and the aerosol generating device 1000 are coupled to each other.

The cigarette 2000 may be similar as a general combustive cigarette. For example, the cigarette 2000 may be divided into a first portion including an aerosol generating material and a second portion including a filter, etc. Alternatively, the second portion of the cigarette 2000 may also include an aerosol generating material. For example, an aerosol generating material made in the form of granules or capsules may be inserted into the second portion.

The entire first portion may be inserted into the aerosol generating device 1000, and the second portion may be exposed to the outside. Alternatively, only a portion of the first portion may be inserted into the aerosol generating device 1000, or the entire first portion and a portion of the second portion may be inserted into the aerosol generating device 1000. The user may puff aerosol while holding the second portion by the mouth of the user. In this case, the aerosol is generated by the external air passing through the first portion, and the generated aerosol passes through the second portion and is delivered to the user's mouth.

For example, the external air may flow into at least one air passage formed in the aerosol generating device 1000. For example, the opening and closing and/or a size of the air passage formed in the aerosol generating device 1000 may be adjusted by the user. Accordingly, the amount of smoke and a smoking impression may be adjusted by the user. As another example, the external air may flow into the cigarette 2000 through at least one hole formed in a surface of the cigarette 2000.

The cigarette 2000 may have the same structure as the smoking article 100 illustrated in FIGS. 4 and 5. However, embodiments are not limited thereto.

In the present specification, it is assumed that a cooling structure 130 according to one or more embodiments is applied to the smoking article 100 used together with the aerosol generating device 1000 (i.e., an electronic cigarette device). However, embodiments are not limited thereto, and the cooling structure 130 according to one or more embodiments may also be applied to a combustion-type cigarette.

FIG. 4 is a diagram illustrating a schematic configuration of a smoking article including a cooling structure according to some embodiments, and FIG. 5 is a cross-sectional view of the smoking article in a central axis direction.

Referring to FIGS. 4 and 5, the smoking article 100 may include a smoking material portion 110, a support structure 120, the cooling structure 130, a mouthpiece portion 140, and a wrapper 150.

Although not shown, at least one of the smoking material portion 110, the support structure 120, the cooling structure 130, and the mouthpiece portion 140 may be individually packaged by a separate wrapper and then packaged again by the wrapper 150. For example, the smoking material portion 110 may be packaged by a smoking material wrapper (not shown), and at least one of the support structure 120, the cooling structure 130, and the mouthpiece portion 140 may be packaged by a filter wrapper (not shown).

A diameter of the smoking article 100 may be within a range of approximately 4 mm to approximately 9 mm, and a length of the smoking article 100 may be approximately 45 mm to approximately 50 mm. However, embodiments are not limited thereto. For example, a length of the smoking material portion 110 may be about 10 mm to about 14 mm (for example, 12 mm), a length of the support structure 120 may be about 8 mm to about 12 mm (for example, 10 mm), a length of the cooling structure 130 may be about 12 mm to about 16 mm (for example, 14 mm), and a length of the mouthpiece portion 140 may be about 10 mm to about 14 mm (for example, 12 mm). However, embodiments are not limited thereto.

The smoking material portion 110 includes an aerosol generating material that generates an aerosol when heated. For example, the aerosol generating material may include at least one of glycerin, propylene glycol, ethylene glycol, dipropylene glycol, diethylene glycol, triethylene glycol, tetraethylene glycol, and oleyl alcohol.

In addition, the smoking material portion 110 may contain other additives such as flavoring agents, wetting agents, and/or organic acids. For example, the flavoring agents may include licorice, sucrose, fructose syrup, isosweet, cocoa, lavender, cinnamon, cardamom, celery, fenugreek, cascarilla, sandalwood, bergamot, geranium, honey essence, rose oil, Vanilla, lemon oil, orange oil, mint oil, cinnamon, caraway, cognac, jasmine, chamomile, menthol, cinnamon, ylang-ylang, sage, spearmint, ginger, cilantro, coffee, or the like. The wetting agents may include glycerin, propylene glycol, or the like.

According to some embodiments, the smoking material portion 110 may be filled with a reconstituted tobacco sheet. According to some other embodiments, the smoking material portion 110 may also be filled with a plurality of tobacco strands which are generated by shredding a reconstituted tobacco sheet. The tobacco strands may be arranged in the same direction (i.e., parallel to each other) or randomly.

For example, a reconstituted tobacco sheet may be manufactured by the following process. First, tobacco raw materials are pulverized to produce a slurry in which an aerosol generating material (for example, glycerin, propylene glycol, etc.), flavoring liquids, binders (for example, guar gum, xanthan gum, carboxymethyl cellulose (CMC), etc.), water, and the like are mixed. When making a slurry, natural pulp or cellulose may be added, and one or more binders may be mixed together. A reconstituted tobacco sheet is formed using the slurry. Tobacco strands may be generated by cutting or shredding a dried reconstituted tobacco sheet.

Tobacco raw materials may include tobacco leaf pieces, tobacco stems and/or tobacco fines generated during tobacco processing. In addition, other additives such as wood cellulose fibers may be contained in the reconstituted tobacco sheet.

Approximately 5% to approximately 40% of the aerosol generating material may be added to the slurry, and approximately 2% to approximately 35% of the aerosol generating material may remain in the reconstituted tobacco sheet. It is desirable that approximately 5% to approximately 30% of the aerosol generating material remain in the reconstituted tobacco sheet. In addition, before a process in which the smoking material portion 110 is wrapped by a smoking material wrapper, a flavoring liquid such as menthol, a moisturizer, or the like may be sprayed onto the center of the smoking material portion 110 to be added.

The support structure 120 may be a tube-shaped structure including a hollow 120H therein. An outer diameter of the support structure 120 may be about 3 mm to about 10 mm, for example about 7 mm. A diameter of the hollow 120H included in the support structure 120 may be within a range of about 2 mm to about 4.5 mm. However, embodiments are not limited thereto. It is desirable that the diameter of the hollow 120H be about 2.5 mm, about 3.4 mm, about 4.2 mm, or the like. However, embodiments are not limited thereto.

The hardness of the support structure 120 may be adjusted during a manufacturing process of the support structure 120 by regulating the content of a plasticizer.

In addition, the support structure 120 may be manufactured by inserting a structure such as a film or tube of the same or different material into the hollow 120H.

The support structure 120 may be manufactured using cellulose acetate. Therefore, when the heater 1300 is inserted into the cigarette 100, an internal material of the smoking material portion 110 may be prevented from being pushed back (i.e., in a downstream direction), and a cooling effect of an aerosol may also be generated.

The support structure 120 according to some embodiments may be a flavored tube filter made of cellulose acetate, to which a flavoring substance such as menthol is applied. For example, the flavored tube filter may be flavored with about 1 mg to about 13 mg (preferably, 1 mg to 7 mg) of a flavoring liquid containing 60 wt % to 80 wt % of menthol and 20 wt % to 40 wt % of propylene glycol (PG).

According to some embodiments, the support structure 120 may be a tube filter moisturized with glycerin and/or PG.

The cooling structure 130 may serve as a cooling member for cooling the aerosol generated by the heater 1300, described with reference to FIGS. 1 to 3, heating the smoking material portion 110. Accordingly, a user may inhale the aerosol cooled to an appropriate temperature.

The cooling structure 130 according to one or more embodiments may include a paper tube (i.e., tube-shaped structure made of paper) having a hollow 130H therein to maximize the cooling effect and to help the flavoring ingredients of the support structure 120 permeate into the mainstream smoke (e.g., a mixture of air and aerosols).

More specifically, when an inner diameter of the cooling structure 130 is larger than an inner diameter of the support structure 120, the mainstream smoke flowing from the hollow 120H of the support structure 120 to the hollow 130H of the cooling structure 130 is diffused, and the movement of the diffused mainstream smoke toward the downstream direction of the smoking article 100 slows down. Therefore, a contact area and contact time between the mainstream smoke and air flowing from the outside into the cooling structure 130 through perforations 160 are increased, and a cooling effect of the mainstream smoke generated accordingly may be improved. Here, when a paper tube having an inner diameter which is about 90% to about 95% of an outer diameter is used as the cooling structure 130, the difference between an inner diameter of the support structure 120 and the inner diameter of the cooling structure 130 may maximize a diffusion effect of the mainstream smoke and the cooling effect of the mainstream smoke.

According to some embodiments, in order to maximize the cooling effect and increase the amount of atomization and the transfer amount of nicotine, the inner diameter of the cooling structure 130 may be 1.5 times to 3 times larger than the inner diameter of the support structure 120. For example, when the inner diameter of the support structure 120 is 2.5 mm, the inner diameter of the cooling structure 130 may be 3.75 mm to 7.5 mm. It is desirable that the inner diameter of the cooling structure 130 be 5 mm to 7.5 mm, and it is most desirable that the inner diameter of the cooling structure 130 be 6 mm to 7 mm.

If the cooling structure is only designed to maximize the cooling efficiency, adequate rigidity may not be obtained, which makes it difficult to manufacture and assemble the cooling structure. Also, the usability of a cigarette including such cooling structure may also be reduced.

Therefore, the cooling structure 130 according to one or more embodiments may have the specifications according to Table 1 below to maximize the cooling efficiency, secure process workability and product usability, and minimize the transition of the flavoring ingredients between segments adjacent to the cooling structure 130 such as the support structure 120 and a mouth filter 140.

TABLE 1

| Classification | Standard |
|---|---|
| Weight (mg) | 70~150 (e.g., 103.5) |
| Length (mm) | 12~16 (e.g., 14) |
| Thickness (mm) | 0.3~1.2 (e.g., 0.52) |
| Outer circumference (mm) | 18~25 (e.g., 21.85) |

TABLE 1-continued

| Classification | Standard |
|---|---|
| Outer diameter (mm) | 6~8 (e.g., 6.96) |
| Inner diameter (mm) | 5~7 (e.g., 5.91) |
| Inner circumference (mm) | 17~24 (e.g., 18.58) |
| Total surface area (mm^2) | 500~700 (e.g., 587.1) |
| Surface area (mm^2/mg) | 4~8 (e.g., 5.7) |
| Basis weight (gsm) | 100~220 (e.g., 169.4) |
| Roundness (%) | 90~99 (e.g., 97) |

A plurality of perforations 160, which penetrate the wrapper 150, may be formed in the cooling structure 130 by an on-line perforation method. During smoking, air from the outside may flow into the hollow 130H of the cooling structure 130 through the plurality of perforations 160, dilute the mainstream smoke, and move to a mouthpiece 640.

The plurality of perforations 160 serve to lower a surface temperature of the mouthpiece and a temperature of the mainstream smoke delivered to a smoker during smoking.

An air dilution rate of the cooling structure 130 may vary depending on the formation conditions of the plurality of perforations 160 (for example, a perforation method, and number, size, and the like of the perforations), and an appropriate air dilution rate may vary depending on the structure and characteristics of the smoking article 100. More specifically, as the air dilution rate increases (for example, as the number of perforations increases), the surface temperature and the temperature of the mainstream smoke may be lowered. However, if the air dilution rate exceeds an appropriate value, the atomization transfer amount (i.e., an amount of air and aerosols transferred through the cooling structure 130) during smoking may decrease.

Therefore, according to one or more embodiments, in order to maintain the surface temperature and the mainstream smoke temperature at an appropriate level, while increasing the glycerin transfer amount, the nicotine transfer amount, and the atomization amount for each puff during smoking, the plurality of perforations 160 may be formed such that the air dilution rate of the cooling structure 130 is about 0% to 50%, preferably 10% to 30%, and most preferably 15% to 25%. Here, the air dilution rate may refer to a ratio of a volume of external air introduced through the cooling structure 130 to a total volume of the mainstream smoke mixed with the introduced external air in the cooling structure 130. The cooling structure 130 according to one or more embodiments has a structure in which a plurality of paper layers are spirally stacked as will be described later, and thus the air dilution rate of the non-perforated cooling structure 130 may be practically 0%.

The plurality of perforations 160 are separated L1 from a downstream end of the cooling structure 130 by 5 mm to 10 mm (preferably, 7 mm to 9 mm) in an upstream direction, and separated L2 from a downstream end of the smoking article 100 by 15 mm to 25 mm (preferably, 18 mm to 22 mm) in an upstream direction. Since the plurality of perforations 160 are formed at the above positions, it is possible to prevent perforation interference by the aerosol generating device 1000 or by the smoker's lips during smoking. Also, it is also possible to alleviate a phenomenon that the acetate filter of the mouthpiece portion is unevenly melted, by smoothing the air flow in the hollow 130H of the cooling structure 130 during smoking.

According to some embodiments, the plurality of perforations 160 may include 4 to 30 holes. However, embodiments are not limited thereto.

A more detailed description of the cooling structure 130 will be provided later with reference to FIGS. 6 to 8.

The mouthpiece portion 140 may serve as a filter that finally delivers the aerosol delivered from the upstream to the user at a downstream end of the smoking article 100. According to some embodiments, the mouthpiece portion 140 may include a cellulose acetate filter. Although not illustrated, the mouthpiece portion 140 may be made of a recess filter.

Although not illustrated, the mouthpiece portion 140 may include at least one capsule (not shown). The capsule may be, for example, a spherical or cylindrical capsule wrapping a content liquid containing a spice with a film.

A material forming the film of the capsule may include starch and/or a gelling agent. For example, gellan gum or gelatin may be used as the gelling agent. In addition, a gelling aid may further be used as a material for forming the film of the capsule. Here, calcium chloride may be used as the gelling aid. Moreover, a plasticizer may further be used as a material for forming the film of the capsule. Here, glycerin and/or sorbitol may be used as the plasticizer. Further, a colorant may further be used as a material for forming the film of the capsule.

The content liquid of the capsule may include a spice such as menthol and essential oils of plants. According to some embodiments, medium chain fatty acid triglyceride (MCTG) may be used as a solvent for the spice contained in the content liquid of the capsule. In addition, the content liquid may contain other additives such as a colorant, an emulsifier, a thickener, and the like.

According to some embodiments, the mouthpiece portion 140 may include a transfer jet nozzle system (TJNS) filter on which a flavoring liquid is sprayed. Alternatively, a separate fiber to which a flavoring liquid is applied may be inserted into the mouthpiece portion 140.

The wrapper 150 may include a porous wrapper or a non-porous wrapper. As an example, a thickness of the wrapper 150 may be about 40 um to about 80 um and a porosity of the wrapper 150 may be about 5 CU to about 50 CU. However, embodiments are not limited thereto.

As aforementioned, at least one of the smoking material portion 110, the support structure 120, the cooling structure 130, and the mouthpiece portion 140 may be individually packaged by a separate wrapper before being wrapped by the wrapper 150. As an example, the smoking material portion 110 may be packaged by a smoking material wrapper (not shown) and the support structure 120, the cooling structure 130, and the mouthpiece portion 140 may be packaged by a first filter wrapper (not shown), a second filter wrapper (not shown), and a third filter wrapper (not shown), respectively. However, the manner of packaging the smoking article 100 and its portions are not limited thereto.

According to some embodiments, the wrappers may have different physical properties depending on their corresponding areas of the smoking article 100.

As an example, a thickness of the smoking material wrapper wrapping the smoking material portion 110 may be about 61 μm and a porosity of the same may be about 15 CU. Also, a thickness of the first filter wrapper wrapping the support structure 120 may be about 63 μm and a porosity of the same may be about 15 CU. However, embodiments are not limited thereto. In addition, an aluminum foil may be further arranged on an inner surface of the smoking material wrapper and/or the first filter wrapper.

The second filter wrapper wrapping the cooling structure 130 and the third filter wrapper wrapping the mouthpiece portion 140 may be made of hard wrappers. For example, a thickness of the second filter wrapper may be about 158 μm and a porosity of the same may be about 33 CU, and a thickness of the third filter wrapper may be about 155 μm and a porosity of the same may be about 46 CU. However, embodiments are not limited thereto.

According to some embodiments, a certain material may be added into the wrapper 150. Here, silicon may an example of the certain material. Silicon has properties such as heat resistance, oxidation resistance, resistance to various chemicals, water repellency, electrical insulation, or the like. However, embodiments are not limited thereto, and any material having the above-described properties may be applied (or coated) to the wrapper 150.

The wrapper 150 may prevent the smoking article 100 from burning. For example, when the smoking material portion 110 is heated by the heater described with reference to FIGS. 1 to 3, the smoking article 100 may be burned. More specifically, when temperature rises above the ignition point of any one of the substances included in the smoking material portion 110, the smoking article 100 may be burned. However, since the wrapper 150 includes a non-combustible material, the smoking article 100 may be prevented from burning.

The wrapper 150 may also prevent a holder of the aerosol generating device 1000 (see FIG. 1) from being contaminated by substances (e.g., liquids) generated from the smoking article 100. Liquids may be generated from the smoking article 100 by the user's puff. For example, when the aerosol generated from the smoking article 100 is cooled by air from the outside, liquids (for example, moisture, etc.) may be generated.

As the wrapper 150 packages the smoking material portion 110 and/or the other portions 120, 130, and 140, the liquid substances generated from the smoking article 100 may be prevented from leaking out. Therefore, the inside of the holder of the aerosol generating device 1000 may be prevented from being contaminated by the liquid substances generated from the smoking article 100.

Although not shown, the smoking article 100 may further include a front filter segment that contacts the smoking material portion 110 at an upstream side of the smoking material portion 110.

The front filter segment may prevent the smoking material portion 110 from falling out of the smoking article 100 and also prevent the aerosol liquefied from the smoking material portion 110 during smoking from flowing into the aerosol generating device 1000 (see FIGS. 1 to 3). In addition, since the front filter segment includes an aerosol channel, the aerosol flowing into an upstream end of the front filter segment may easily move to a downstream end of the front filter segment. Thus, the user may easily inhale the aerosol.

According to some embodiments, the front filter segment may be made of cellulose acetate.

The aerosol channel may be located in the center of the front filter segment. For example, the center of the aerosol channel may coincide with the center of the front filter segment. A cross-sectional shape of the aerosol channel may be in various shapes, such as a circular shape, a trilobal shape, or the like.

FIGS. 6 to 8 are diagrams illustrating a layer structure of a cooling structure according to some embodiments. In FIGS. 6 to 8, the cooling structure 130 is simplified and rather exaggerated for clarity of description. For example, in order to precisely describe the positional relationship of spiral layers 130*a*, 130*b*, and 130*c* on a body portion of the cooling structure 130, a length of the cooling structure 130 in an axial direction is illustrated as relatively longer and a diameter of the cooling structure 130 is illustrated as relatively shorter. In addition, only the body portion is illustrated excluding the plurality of perforations 160 described with reference to FIGS. 4 and 5.

Referring to FIGS. 6 to 8, the body portion has the inner layer paper spiral layer 130*a*, the intermediate layer paper spiral layer 130*b*, and the outer layer paper spiral layer 130*c* which are sequentially stacked. The inner layer paper and an intermediate layer paper may be attached to each other by an adhesive. Also, the intermediate layer paper and an outer layer paper may be attached to each other by an adhesive. Considering a process of cutting an elongated rod formed by spiral layers into the individual cooling structure 130 having a roundness of about 90% to about 99%, and for the cooling structure 130 to effectively performs a cooling function after being coupled to the smoking article 100, the adhesive may be ethylene vinyl acetate (EVA) containing solids of 30 wt % to 60 wt % (preferably, 43% to 46 wt %), a viscosity of 12,000 cps to 18,000 cps (preferably 14,000 cps to 16,000 cps), and a pH of 3 to 6. Hereinafter, each layer will be described with reference to a separate drawing.

Referring to FIG. 6, an innermost layer of the body portion of the cooling structure 130 is the inner layer paper spiral layer 130*a* formed of inner layer paper.

A width 130*a*L (i.e., a dimension in an axial direction S of the cooling structure 130) of the inner layer paper constituting the inner layer paper spiral layer 130*a* may be about 15 mm to about 25 mm (for example, about 20 mm). However, embodiments are not limited thereto.

A downstream end of a first inner layer paper surface 130*a*1 constituting the inner layer paper spiral layer 130*a* and an upstream end of a second inner layer paper surface 130*a*2 adjacent to the first inner layer paper surface 130*a*1 are practically parallel to each other such that a boundary line 130*as* is formed between them. An angle 130*ag* formed between the boundary line 130*as* and the axial direction S of the cooling structure 130 may be about 40° to 55°.

To secure flatness of the intermediate layer paper spiral layer 130*b* and of the outer layer paper spiral layer 130*c* to be stacked on the inner layer paper spiral layer 130*a* and airtightness of the body portion, adjacent inner layer paper surfaces (e.g., a downstream end of the first inner layer paper surface 130*a*1 and an upstream end of the second inner layer paper surface 130*a*2) of the inner layer paper spiral layer 130*a* may not overlap with each other. For example, adjacent inner layer paper surfaces may be in contact with each other without overlapping, or may be separated from each other by 0 mm to 2 mm (preferably, more than 0 mm and 1 mm or less).

According to some embodiments, in order to form a uniform spiral structure, the inner layer paper may have a basis weight of 50 gsm to 70 gsm and a thickness of 0.05 mm to 0.10 mm.

Referring to FIG. 7, the intermediate layer paper spiral layer 130*b* is formed on the inner layer paper spiral layer 130*a* of the cooling structure 130. In FIG. 7, the boundary line 130*as* of the inner layer paper spiral layer 130*a* is illustrated as a dotted line, and a boundary line 130*bs* of the intermediate layer paper spiral layer 130*b* is illustrated as a solid line.

A width 130*b*L (i.e., a dimension in the axial direction S of the cooling structure 130) of the intermediate layer paper constituting the intermediate layer paper spiral layer 130*b* may be about 15 mm to about 25 mm (e.g., about 20 mm). However, embodiments are not limited thereto.

A downstream end of a first intermediate layer paper surface 130*b*1 constituting the intermediate layer paper spiral layer 130*b* and an upstream end of a second intermediate layer paper surface 130*b*2 adjacent to the first intermediate layer paper surface 130*b*1 are practically parallel to each other such that the boundary line 130*bs* may be formed between them. An angle 130*bg* formed between the boundary line 130*bs* and the axial direction S of the cooling structure 130 may be about 40° to 55°.

Considering flatness of the intermediate layer paper spiral layer 130*b* and of the outer layer paper spiral layer 130*c* to be stacked on the intermediate layer paper spiral layer 130*b* and airtightness of the body portion, adjacent intermediate layer paper surfaces (e.g., a downstream end of the first intermediate layer paper surface 130*b*1 and an upstream end of the second intermediate layer paper surface 130*b*2) may not overlap with each other and may be in contact with each other, or may be separated from each other by 0 mm to 2 mm (preferably, more than 0 mm and 1 mm or less). The boundary line 130*bs* of the intermediate layer paper spiral layer 130*b* may be apart from the boundary 130*as* of the inner layer paper spiral layer 130*a* by the distance sh1 in an axial direction S of the cooling structure 130. For example, the distance sh1 may be 7 mm to 13 mm. That is, the downstream end of the first intermediate layer paper surface 130*b*1 may be apart from the downstream end of the first inner layer paper surface 130*a*1 by 7 mm to 13 mm in the axial direction of the smoking article.

According to some embodiments, in order to secure rigidity and airtightness of the cooling structure 130, the intermediate layer paper may have a basis weight of 100 gsm to 160 gsm (preferably, 120 gsm to 160 gsm) and a thickness of 0.1 mm to 0.2 mm (preferably, 0.15 mm to 0.20 mm).

Referring to FIG. 8, the outer layer paper spiral layer 130*c* is formed on the intermediate layer paper spiral layer 130*b* of the cooling structure 130. In FIG. 8, the boundary line 130*bs* of the intermediate layer paper spiral layer 130*b* is illustrated as a dotted line, and a boundary line 130*cs* of the outer layer paper spiral layer 130*c* is illustrated as a solid line.

A width 130*c*L (a dimension in the axial direction S of the cooling structure 130) of the outer paper constituting the outer layer paper spiral layer 130*c* may be about 15 mm to about 25 mm (e.g., about 20 mm). However, embodiments not limited thereto.

A downstream end of a first outer layer paper surface 130*c*1 constituting the outer layer paper spiral layer 130*c* and an upstream end of a second outer layer paper surface 130*c*2 adjacent to the first outer layer paper surface 130*c*1 are practically in parallel to each other such that the boundary line 130*cs* is formed between them. An angle 130*cg* formed between the boundary line 130*cs* and the axial direction S of the cooling structure 130 may be about 30° to 60° (preferably, 40° to 55°).

In order to prevent contamination of the outside of a paper tube of the outer layer paper spiral layer 130*c* and separation of the spiral layer during a cigarette manufacturing process while securing flatness of the surface, adjacent outer layer paper surfaces (for example, a downstream end of the first outer layer paper surface 130*c*1 and an upstream end of the second outer layer paper surface 130*c*2) constituting the outer layer paper spiral layer 130*c* may overlap with each other by 0 mm to 2 mm (preferably, more than 0 mm and 1 mm or less) or may be in contact with each other without overlapping. The boundary line 130*cs* of the outer layer paper spiral layer 130*c* may be apart from the boundary line 130*bs* of the intermediate layer paper spiral layer 130*b* by the distance sh2 in an axial direction S of the cooling structure 130. For example, the distance sh2 may be 5 mm to 15 mm (preferably, 7 mm to 13 mm). That is, the downstream end of the first outer layer paper surface 130*c*1 may be apart from the downstream end of the first intermediate layer paper surface 130*b*1 by 5 mm to 15 mm (preferably, 7 mm to 13 mm) in the axial direction of the smoking article.

According to some embodiments, as the intermediate layer paper spiral layer 130*b* is shifted with respect to the inner layer paper spiral layer 130*a* and the outer layer paper spiral layer 130*c* is shifted with respect to the intermediate layer paper spiral layer 130*b*, the outer layer paper spiral layer 130*c* may have a spiral structure practically overlapping with the inner layer paper spiral layer 130*a*. That is, the outer layer paper spiral layer 130*c* may not be shifted with respect to the inner layer paper spiral layer 130*a*.

According to some embodiments, in order to form rigidity and airtightness of the cooling structure, the outer layer may have a basis weight of 100 gsm to 160 gsm (preferably, 120 gsm to 160 gsm) and a thickness of 0.1 mm to 0.2 mm (preferably, 0.15 mm to 0.20 mm).

As the body portion of the cooling structure 130 is formed with the physical properties and a coupling structure for each paper layer as described above, the cooling structure 130 may secure rigidity and airtightness of the cooling structure required in a subsequent process, and at the same time, may prevent contamination of the outside of the paper tube and separation of the spiral layer, and further may secure uniformity and flatness of the cooling structure.

Hereinafter, configuration of one or more embodiments and effects thereof will be described in greater detail through embodiments and comparative examples. However, the embodiments are mere examples, and the scope of the present disclosure is not limited to the embodiments described below.

141Comparative Example 1

Similar to the smoking article 100 shown in FIG. 4, a heating-type cigarette having a structure with a smoking material portion, a support structure, a cooling structure, and a mouthpiece portion was manufactured. A cellulose acetate (CA) tube filter having an inner diameter of 2.5 mm that was not flavored was used as the support structure, and a CA tube filter having an inner diameter of 4.2 mm that was not flavored was used as the cooling structure. A TJNS filter, in which a menthol-flavored liquid of about 6 mg was applied, was used for the mouthpiece portion.

Comparative Example 2

Except that a CA filter, in which a menthol-flavored liquid of about 6 mg was applied, was used for the support structure, a heating-type cigarette identical with that of Comparative Example 1 was manufactured.

Comparative Example 3

Except that the cooling structure was made of a woven polylactic acid (PLA) fabric, a heating-type cigarette identical with that of Comparative Example 2 was manufactured.

Embodiment 1

Except that the cooling structure was formed with a non-perforated (i.e., air dilution rate of 0%) paper tube, a heating-type cigarette identical with that of Comparative Example 2 was manufactured. More specifically, a paper tube having a weight of about 103 mg, a length of about 14 mm, a thickness of about 0.52 mm, a total surface area of about 587 $mm^2$, and a roundness of about 97% was used.

Embodiment 5

Except that the cooling structure was formed with a perforated paper tube having an air dilution rate of 50%, a heating-type cigarette identical with that of Embodiment 1 was manufactured.

Table 2 shows structures of the cigarettes according to Comparative Examples 1 to 3 and Embodiments 1 to 5. Except for Comparative Example 1 in which a non-flavored CA tube filter was used as the support structure, a total amount of menthol-flavored liquid that was added to the cigarettes of Comparative Examples and Embodiments is practically the same.

TABLE 2

| Classification | Cooling structure | | | Support structure | Smoking material portion | Mouthpiece portion |
|---|---|---|---|---|---|---|
| Comparative Example 1 | Acetate tube 4.2 mm | | | Acetate tube 2.5 mm, non-flavored | Identical | Identical |
| Comparative Example 2 | | | | Acetate tube 2.5 mm, flavored | | |
| Comparative Example 3 | Woven PLA fabric | | | | | |
| Embodiment 1 | Paper tube | Perforations | 0% | | | |
| Embodiment 2 | | | 10% | | | |
| Embodiment 3 | | | 17% | | | |
| Embodiment 4 | | | 30% | | | |
| Embodiment 5 | | | 50% | | | |

Embodiment 2

Except that the cooling structure was formed with a perforated paper tube having an air dilution rate of 10%, a heating-type cigarette identical with that of Embodiment 1 was manufactured.

Embodiment 3

Except that the cooling structure was formed with a perforated paper tube having an air dilution rate of 17%, a heating-type cigarette identical with that of Embodiment 1 was manufactured.

Embodiment 4

Except that the cooling structure was formed with a perforated paper tube having an air dilution rate of 30%, a heating-type cigarette identical with that of Embodiment 1 was manufactured.

Experimental Example 1

Analysis of Menthol Content of Cigarette Segments According to Storage Time of a Cigarette After Manufacture In order to confirm a transfer pattern of menthol during storage of the cigarettes, the menthol content of each segment was analyzed according to the storage time, and the results are presented in Table 3. Analysis results of Embodiments 2 to 5 were excluded from Table 3, because there was no significant difference due to the presence or absence of perforations and the air dilution rate in a menthol transfer pattern analysis. In addition, Comparative Example 1, which had much less absolute menthol content than other Embodiments and Comparative Examples, was excluded from the present experiment.

TABLE 3

| Classification | | | Menthol distribution by portions | | | | | |
|---|---|---|---|---|---|---|---|---|
| | | | Medium | Support | Cooling | Acetate | Etc. | Sum |
| Comparative Example 2 | Tube 4.2 mm) | Week 1 | 10.8 | 16.4 | 27.4 | 26.0 | 19.4 | 100 |
| | | Week 2 | 16.4 | 20.4 | 29.1 | 18.5 | 15.6 | 100 |
| | | Week 4 | 18.5 | 21.9 | 28.7 | 16.6 | 14.3 | 100 |
| Comparative Example 3 | PLA | Week 1 | 12.5 | 20.6 | 8.6 | 25.2 | 33.1 | 100 |
| | | Week 2 | 13.8 | 18.8 | 11.5 | 21.7 | 34.2 | 100 |
| | | Week 4 | 14.1 | 15.6 | 15.2 | 18.5 | 36.6 | 100 |
| Embodiment 1 | Paper tube (0%) | Week 1 | 15.6 | 23.3 | 2.8 | 32.0 | 26.3 | 100 |
| | | Week 2 | 24.7 | 27.8 | 4.0 | 24.1 | 19.4 | 100 |
| | | Week 4 | 26.8 | 29.6 | 3.1 | 22.9 | 17.6 | 100 |

As shown in Table 3, although the same amount of menthol-flavored liquid for each embodiment was added to the support structure and the mouthpiece portion (i.e., acetate tube) of each of the cigarettes, it may be identified that menthol distribution differs depending on the storage time of the cigarette after manufacture. Accordingly, it may be identified that the menthol transfer pattern in the cigarettes differs depending on the cooling structure to which the menthol-flavored liquid was not added.

More specifically, in the case of Comparative Example 2, it may be identified that a significant amount of menthol initially contained in the support structure and the acetate tube is transferred to the cooling structure as the storage time elapses after manufacture, and accordingly, the menthol content of the medium portion (i.e., smoking material portion 110) and the acetate tube is relatively low compared to Comparative Example 3 or Embodiment 1.

On the other hand, in the case of Comparative Example 3, the menthol transfer amount toward the cooling structure is less than that of Comparative Example 2, but a larger amount of menthol is transferred to the cooling structure than in Embodiment 1, and this tendency became more apparent as the storage time increased. In addition, in the case of Comparative Example 3, since the menthol transfer amount toward other segments (wrappers) was large, an actual menthol transfer amount within the mainstream smoke was expected to be less than that of Embodiment 1 because of loss of flavors due to the state of storage.

In the case of Embodiment 1, as the storage time increased, the menthol content of the medium portion and the support structure increased remarkably, and it may be identified that the menthol transfer to the cooling structure was substantially insignificant. From the above results, it is predicted that the menthol transfer amount will be greater during smoking in Embodiment 1 than in Comparative Examples 2 and 3.

Experimental Example 2

Smoke Components Analysis

In order to analyze components of smoke of the cigarettes of Comparative Examples 2 and 3, and Embodiments 1 to 5, components of the mainstream smoke of cigarettes stored for 2 weeks after manufacture were analyzed. Smoke collection for the component analysis was conducted repeatedly based on three times for each sample and 8 puffs for each time, and the results of the component analysis based on an average value for three collections are shown in Table 4. The cigarettes were tested according to Health Canada (HC) smoking conditions using an automatic smoking device in a smoking room with a temperature of approximately 20° C. and a humidity of approximately 62.5%.

TABLE 4

| Classification | | Nic. (mg/cig.) | PG (mg/cig.) | Gly. (mg/cig.) | Moisture (mg/cig.) | Menthol (mg/cig.) |
|---|---|---|---|---|---|---|
| Comparative Example 2 | Tube (4.2 mm) | 0.93 | 0.52 | 3.32. | 29.3 | 1.05 |
| Comparative Example 3 | PLA | 1.04 | 0.56 | 3.67 | 30.8 | 1.24 |
| Embodiment 1 | Paper tube (0%) | 1.06 | 0.54 | 3.82 | 30.6 | 1.53 |
| Embodiment 2 | Paper tube (10%) | 1.16 | 0.54 | 5.32 | 33.0 | 1.47 |
| Embodiment 3 | Paper tube (17%) | 1.14 | 0.50 | 5.20 | 30.2 | 1.42 |
| Embodiment 4 | Paper tube (30%) | 1.13 | 0.45 | 5.22 | 28.2 | 1.44 |
| Embodiment 5 | Paper tube (50%) | 0.96 | 0.37 | 3.94 | 20.7 | 1.21 |

As shown in Table 4, PG and moisture amounts did not show a significant difference between the Examples (except for Example 5), but nicotine, glycerin and menthol transfer amounts varied depending on an application direction and an air dilution rate of the cooling structure.

More specifically, in Embodiments 1 to 5 in which a paper tube was applied as the cooling structure, glycerin and menthol transfer amounts overall increased compared to Comparative Examples 2 and 3. On the other hand, it may be identified that in Embodiment 1, in which a non-perforated paper tube was applied, the glycerin transfer amount was relatively reduced due to rather excessive thermal deformation of the acetate tube compared to other examples. On the other hand, in Embodiment 5, due to the large amount of air introduced in the paper tube, nicotine, PG, glycerin, and menthol transfer amounts significantly decreased.

It may be identified that in Embodiments 2 to 4 in which the cooling structure has an air dilution rate of 10% to 30% according to the perforations, nicotine and glycerin transfer amounts remarkably increased compared to other Embodiments, which is due to the minimizing of the thermal deformation of the acetate tube and the dilution of an appropriate amount of air introduced from the outside.

Experimental Example 3

Analysis of Atomization Amount and Smoke Components According to Puffs

To analyze the amount of atomization and the transfer amount of smoke components according to puffs, the amount of atomization and the smoke components of the mainstream smoke of the cigarettes according to Comparative Example 2 and Embodiment 2 were analyzed, and the analysis results of the transfer amount for each component are shown in FIGS. 9 to 11.

FIG. 9 is a graph showing nicotine content in smoke for each puff, FIG. 10 is a graph showing glycerin content in smoke for each puff, and FIG. 11 is a graph showing menthol content in smoke for each puff.

Referring to FIGS. 9 to 11, it may be identified that a nicotine transfer amount, a glycerin transfer amount, and a menthol transfer amount are all higher in Embodiment 2 than in Comparative Example 2. In both Embodiment 2 and Comparative Example 2, as the puff order increased, the nicotine transfer amount and the glycerin transfer amount increased. However, as the nicotine transfer amount and the glycerin transfer amount rapidly increase from an initial puff in Embodiment 2 compared to Comparative Example 2, Embodiment 2 is expected to be more advantageous than Comparative Example 2 in terms of persistence of smoking taste and the atomization amount. Accordingly, Embodiment 2 is also expected to have advantage in alleviating burnt taste or irritation in later puffs over Comparative Example 2.

In addition, in both Embodiment 2 and Comparative Example 2, the menthol amount increased from the initial 3 to 4 puffs and then decreased in subsequent puffs. Still, in the case of Embodiment 2, the menthol transfer amount increased relatively rapidly from the first puff, and there was no significant difference in the reduction rate in later puffs compared with Comparative Example 2. Therefore, it may be identified that Embodiment 2 also has advantage in terms of persistence of menthol during smoking over Comparative Example 2.

Experimental Example 4

Analysis of Cigarette Surface and Mainstream Smoke Temperatures

In order to evaluate heat on cigarette surface and in mainstream smoke, surface temperatures and mainstream smoke temperatures of cigarettes stored for 2 weeks after manufacture were analyzed according to Comparative Examples 2 and 3 and Embodiments 1 to 5, and the analysis results are shown in Table 5. Each of the surface temperatures and the mainstream smoke temperatures represents an average value of a maximum temperature measured for each puff, based on 5 times for each sample.

TABLE 5

| Classification | | Surface temperature (° C.) | Mainstream smoke temperature (° C.) | Remark |
|---|---|---|---|---|
| Comparative Example 2 | Tube (4.2 mm) | 57.4 | 61.2 | Partial acetate melting (Mostly the center of the cross section) |
| Comparative Example 3 | PLA | 54.5 | 59.1 | Partial acetate melting(Mostly the center of the cross section) |
| Embodiment 1 | Paper tube (0%) | 58.2 | 59.6 | Partial acetate melting(throughout the cross section) |
| Embodiment 2 | Paper tube (10%) | 55.7 | 56.9 | Partial acetate melting(throughout the cross section) |
| Embodiment 3 | Paper tube (17%) | 52.5 | 56.3 | Little acetate melting(throughout the cross section) |
| Embodiment 4 | Paper tube (30%) | 45.9 | 53.2 | Little acetate melting(throughout the cross section) |
| Embodiment 5 | Paper tube (50%) | 42.8 | 48.1 | Little acetate melting(throughout the cross section) Too little draw resistance Drop in the intensity of smoking taste |

Referring to Table 5, in the case of Embodiment 1 in which a non-perforated paper tube was applied, the surface temperature was rather higher than that of Comparative Example 3, and similar to that of Comparative Example 2, and the mainstream smoke temperature was identical or similar to that of Comparative Examples 2 and 3. On the other hand, in the case of Embodiment 1, unlike Comparative Examples 2 and 3, heat was diffused to the entire cross section, so that the centralized melting of the mouthpiece was greatly alleviated.

In Embodiments 2 to 5 in which a perforated paper tube was applied, a significant drop in the surface temperature and the mainstream smoke temperature was observed compared to Comparative Examples 2 and 3, and the temperature linearly decreased as the air dilution rate increased. It was identified that in Embodiments 5 in which a paper tube having the highest air dilution rate was applied, a cooling effect was the most excellent, but there were issues such as lack of draw resistance and a drop in the intensity of smoking taste, which were not observed in Embodiments 2 to 4.

Experimental Example 5

Evaluation of Smoking Feeling

In order to analyze the smoking feeling of the Comparative Examples and the Embodiments, the amount of atomization, draw resistance, heat of mainstream smoke and cigarette surface heat sensation, the intensity of smoking taste, irritation, different taste of the cigarettes, and overall smoking feeling was rated according to Comparative Examples 2 and 3, and Embodiments 2 to 4 in which only configuration of the cooling structure was changed. The results are shown in Table 6. The evaluation was conducted by 25 evaluation panel members with cigarettes stored for two weeks after manufacture, based on a rating scale of 0 to 5.

TABLE 6

| | Comparative Example 2 (Tube 4.2 mm) | Comparative Example 3 (PLA) | Embodiment 2 (Paper tube 10%) | Embodiment 3 (Paper tube 17%) | Embodiment 4 (Paper tube 30%) |
|---|---|---|---|---|---|
| Atomization amount | 3.21 | 3.37 | 4.07 | 4.06 | 4.10 |
| Persistence of atomization amount | 3.91 | 4.17 | 4.38 | 4.32 | 4.31 |
| Draw resistance | 4.01 | 3.70 | 3.90 | 3.97 | 4.08 |
| Heat in mainstream smoke | 3.70 | 3.59 | 3.56 | 3.52 | 3.27 |
| Heat on | 4.01 | 3.73 | 3.60 | 3.48 | 3.29 |

TABLE 6-continued

| | Comparative Example 2 (Tube 4.2 mm) | Comparative Example 3 (PLA) | Embodiment 2 (Paper tube 10%) | Embodiment 3 (Paper tube 17%) | Embodiment 4 (Paper tube 30%) |
|---|---|---|---|---|---|
| cigarette surface | | | | | |
| Intensity of smoking taste | 3.81 | 3.93 | 4.11 | 4.00 | 3.69 |
| Irritation | 3.50 | 3.72 | 3.64 | 3.61 | 3.52 |
| Different taste | 3.49 | 3.51 | 3.37 | 3.48 | 3.38 |
| Overall smoking feeling | 3.85 | 3.78 | 4.11 | 4.10 | 4.02 |

Referring to Table 6, it may be identified that in both Examples 2 to 4 in which a perforated paper tube was applied, the atomization amount and the persistence of the atomization amount are remarkably excellent, and the overall smoking feeling also showed an excellent figure showing a significant difference compared to Comparative Examples in which a CA tube or PLA was applied. In particular, in the case of Embodiments 2 and 3, it was identified that the intensity of the smoking taste was also the highest of all, and different taste was also reduced.

At least one of the components, elements, modules or units (collectively "components" in this paragraph) represented by a block in the drawings, such as the controller 1200 in FIGS. 1-3, may be embodied as various numbers of hardware, software and/or firmware structures that execute respective functions described above, according to an exemplary embodiment. For example, at least one of these components may use a direct circuit structure, such as a memory, a processor, a logic circuit, a look-up table, etc. that may execute the respective functions through controls of one or more microprocessors or other control apparatuses. Also, at least one of these components may be specifically embodied by a module, a program, or a part of code, which contains one or more executable instructions for performing specified logic functions, and executed by one or more microprocessors or other control apparatuses. Further, at least one of these components may include or may be implemented by a processor such as a central processing unit (CPU) that performs the respective functions, a microprocessor, or the like. Two or more of these components may be combined into one single component which performs all operations or functions of the combined two or more components. Also, at least part of functions of at least one of these components may be performed by another of these components. Further, although a bus is not illustrated in the above block diagrams, communication between the components may be performed through the bus. Functional aspects of the above exemplary embodiments may be implemented in algorithms that execute on one or more processors. Furthermore, the components represented by a block or processing steps may employ any number of related art techniques for electronics configuration, signal processing and/or control, data processing and the like.

Those of ordinary skill in the art related to the present embodiments may understand that various changes in form and details can be made therein without departing from the scope of the characteristics described above. The disclosed methods should be considered in a descriptive sense only and not for purposes of limitation. The scope of the present disclosure is defined by the appended claims rather than by the foregoing description, and all differences within the scope of equivalents thereof should be construed as being included in the present disclosure.

The invention claimed is:

1. A smoking article comprising:

a smoking material portion;

a cooling structure made of a paper material, having a tube shape, and located downstream of the smoking material portion;

a mouthpiece portion located downstream of the cooling structure; and a wrapper surrounding the smoking material portion, the cooling structure, and the mouthpiece portion, wherein the cooling structure comprises:

a body portion having a tube shape and made of a paper material; and a plurality of perforations arranged in a circumferential direction of the body portion such that an outside and an inside of the body portion are in fluid communication with each other, wherein the body portion is formed by an inner layer paper spiral layer, an intermediate layer paper spiral layer, and an outer layer paper spiral layer, which are sequentially stacked, and wherein the inner layer paper spiral layer is formed of paper having a basis weight of 50 gsm to 70 gsm and a thickness of 0.05 mm to 0.10 mm, the intermediate layer paper spiral layer is formed of paper having a basis weight of 120 gsm to 160 gsm and a thickness of 0.15 mm to 0.2 mm, and the outer layer paper spiral layer is formed of paper having a basis weight of 120 gsm to 160 gsm and a thickness of 0.15 mm to 0.2 mm.

2. The smoking article of claim 1, further comprising a support structure arranged between the smoking material portion and the cooling structure, having a tube shape, made of cellulose acetate, and flavored with a flavoring substance.

3. The smoking article of claim 2, wherein an inner diameter of the cooling structure is larger than an inner diameter of the support structure.

4. The smoking article of claim 2, wherein a length of the support structure in an axial direction is 8 mm to 12 mm, a length of the cooling structure in the axial direction is 12 mm to 16 mm, and a length of the mouthpiece portion in the axial direction is 8 mm to 12 mm.

5. The smoking article of claim 2, wherein the plurality of perforations are separated from a downstream end of the cooling structure by 5 mm to 10 mm in an upstream direction, and separated from a downstream end of the smoking article by 15 mm to 25 mm in the upstream direction.

6. The smoking article of claim 2, wherein the support structure comprises 1 mg to 13 mg of the flavoring substance.

7. The smoking article of claim 1, wherein an air dilution rate of the cooling structure is 0% to 50%.

8. A cooling structure located downstream of a smoking material portion and upstream of a mouthpiece portion in a smoking article, the cooling structure comprising:

a body portion having a tube shape and made of a paper material; and a plurality of perforations arranged in a circumferential direction of the body portion such that an inside and an outside of the body portion are in fluid communication with each other, wherein the body portion is formed by an inner layer paper spiral layer, an intermediate layer paper spiral layer, and an outer layer paper spiral layer, which are sequentially stacked, and wherein the inner layer paper spiral layer is formed of paper having a basis weight of 50 gsm to 70 gsm and a thickness of 0.05 mm to 0.10 mm, the intermediate layer paper spiral layer is formed of paper having a basis weight of 120 gsm to 160 gsm and a thickness of 0.15 mm to 0.2 mm, and the outer layer paper spiral layer is formed of paper having a basis weight of 120 gsm to 160 gsm and a thickness of 0.15 mm to 0.2 mm.

9. The cooling structure of claim 8, wherein an inner diameter of the cooling structure is 90% to 95% of an outer diameter of the cooling structure, and a roundness of the cooling structure is 90% to 99%.

10. The cooling structure of claim 8, wherein a total surface area of the cooling structure is 500 $mm^2$ to 700 $mm^2$, and a basis weight of the cooling structure is 100 gsm to 220 gsm.

11. The cooling structure of claim 8, wherein the inner layer paper spiral layer and the intermediate layer paper spiral layer are attached to each other by an adhesive, the intermediate layer paper spiral layer and the outer layer paper spiral layer are attached to each other by the adhesive, and the adhesive is ethylene vinyl acetate (EVA) containing solids of 30 wt % to 60 wt %, and having a viscosity of 12,000 cps to 18,000 cps, and a pH of 3 to 6.

12. The cooling structure of claim 8, wherein a downstream end of a first inner layer paper surface constituting the inner layer paper spiral layer and an upstream end of a second inner layer paper surface adjacent to the first inner layer paper surface are separated from each other by 0 mm to 2 mm, a downstream end of a first intermediate layer paper surface constituting the intermediate layer paper spiral layer and an upstream end of a second intermediate layer paper surface adjacent to the first intermediate layer paper surface are separated from each other by 0 mm to 2 mm, and a downstream end of a first outer layer paper surface constituting the outer layer paper spiral layer and an upstream end of a second outer layer paper surface adjacent to the first outer layer paper surface overlap with each other by 0 mm to 2 mm.

13. The cooling structure of claim 12, wherein an angle between an axial line of the smoking article and a line defining the downstream end of the first inner layer paper surface, the downstream end of the first intermediate layer paper surface, and the downstream end of the first outer layer paper surface is 30° to 60°.

* * * * *